United States Patent [19]

Villeneuve

[11] Patent Number: 4,788,941

[45] Date of Patent: Dec. 6, 1988

[54] SAFETY BELT

[76] Inventor: Gerald P. Villeneuve, 125 Avenue Road, Kapuskasing, Ontario P5N 3A4, Canada

[21] Appl. No.: 53,028

[22] Filed: May 20, 1987

[51] Int. Cl.[4] ..... A62B 35/00

[52] U.S. Cl. ..... 119/96; 119/109; 128/876

[58] Field of Search ..... 119/96, 106, 109, 126; 128/133, 134; 24/165

[56] References Cited

U.S. PATENT DOCUMENTS

| | | | |
|---|---|---|---|
| 579,818 | 3/1897 | Cooley | 119/96 |
| 2,650,590 | 9/1953 | Moore et al. | 128/134 |
| 2,994,300 | 8/1961 | Grahling | 119/96 |
| 3,104,650 | 9/1963 | Grahling | 119/96 |
| 3,295,501 | 1/1967 | Riley | 119/96 |
| 3,480,275 | 11/1969 | Jernstrom et al. | 128/134 |
| 3,970,316 | 7/1976 | Westmoreland, Jr. | 128/134 |
| 4,273,215 | 6/1981 | Leggett | 119/96 |
| 4,638,764 | 1/1987 | Anderson | 119/96 |
| 4,688,564 | 8/1987 | Kelly | 128/133 |

FOREIGN PATENT DOCUMENTS

| | | | |
|---|---|---|---|
| 1101811 | 5/1981 | Canada | 273/29 |
| 2002445 | 2/1979 | United Kingdom | 24/165 |

*Primary Examiner*—Robert Peshock

*Attorney, Agent, or Firm*—Browdy and Neimark

[57] ABSTRACT

A safety device for use in the care of children is disclosed. The safety device comprises a one piece flexible belt and a pair of fastening elements. Each of the fastening elements comprises two components, one of which is fixedly secured to the end of the flexible belt. The other of the said components is movable toward or away from the end of the flexible belt so that when the two components of each fastening element are connected, a pair of belts are formed which are adapted to be secured around an adult and a child so that they are joined together in side-by-side relation.

3 Claims, 1 Drawing Sheet

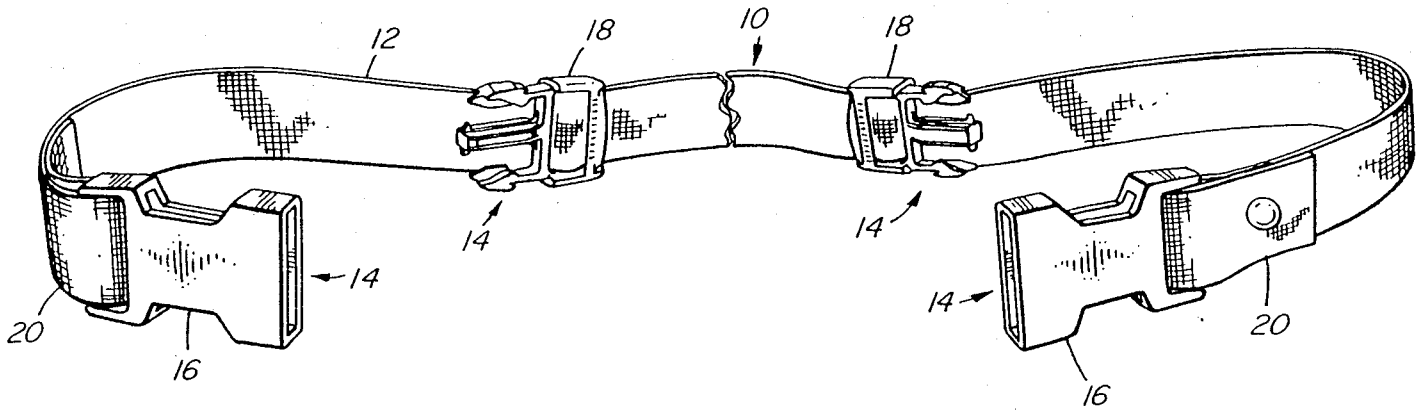
20
16
14
18
14
10
18
14
12
14
16
20

SAFETY BELT

FIELD OF THE INVENTION

This invention relates to a safety device, specifically to a safety belt for children.

BACKGROUND OF THE INVENTION

There are various types of restraining devices for children that have been in use for some time. Conventional restraining devices, such as those disclosed in U.S. Pat. Nos. 3,104,650 and 3,295,501 comprise a pair of belts linked to each other by a tether. Each of the belts can be adjusted around the waist of the users to a limited extent. Such devices are bulky to carry to store when not in use.

SUMMARY OF THE INVENTION

In general terms, according to the invention, there is provided a safety device for use in the care of children. The device comprises a flexible belt and a pair of fastening means. Each of the fastening means comprise two elements, one of which is secured to an end of the flexible belt. The other element is movable towards or away from the said end of the flexible belt. When the two elements of each fastening means are connected, a pair of belts are formed with a connecting portion therebetween, one belt being secured about an adult, the other about a child.

It is an object of the present invention to provide a safety device comprising a one-piece element.

It is a further object to provide a safety device which is easy to manufacture.

It is another object to provide a safety device which is easy to store or carry when not in use.

BRIEF DESCRIPTION OF THE DRAWING

The invention is illustrated by way of example in the accompanying drawing in which a perspective view of the invention is illustrated.

DESCRIPTION OF THE PREFERRED EMBODIMENT

Referring to the drawing, a safety device indicated generally as 10 is adapted for use in the care of children. It comprises a one piece flexible band or belt 12 and a pair of fastening elements 14. Each fastening element 14 comprises two commercially available components, a female component 16 and a male component 18. One of the two components, illustrated as the female component 16 in the drawing, is fixedly secured to both ends

20 of the flexible belt 12. The other component, illustrated as the male component 18 is movable along the belt 12 towards or away from the ends 20 of the belt 12.

In use, the parent and the child position themselves so as to wrap the end portion 20 of the band 12 around their respective waists. The male component 18 is then moved towards or away from the female component 16 so as to snugly fit around the waist of each user and the female 16 and male 18 components are then connected. The bans 12 is of such a length that when the parent and child have it fastened around their waists, they are linked together in side-by-side relation and there is a sufficient length of the band 12 left between them to give both users some freedom of movement. In an alternative embodiment, the band 12 can be adjusted around each user's wrist or alternatively, around one user's wrist and the other's waist. Where the parent wishes not to have the child restrained, he or she may attach the child belt around his or her own waist. When not in use, the safety device can be rolled onto itself and conveniently stored.

While the present invention has been described in connection with a specific embodiment thereof and for a specific use, various modifications will occur to those skilled in the art without departing from the spirit and scope of the invention as set forth in the appended claims. I therefore wish to embody within the scope of the patent which may be grated hereon all such embodiments as reasonably and properly fall within the scope of may contribution to the art.

The embodiments of the invention for which an exclusive property or privilege is claimed are defined as follows:

1. A safety device for use in the care of children, said device comprising a single flexible belt, a pair of fastening means, each of said fastening means comprising two elements, one of said elements being secured to an end of the flexible belt, the other of said elements being movable towards or away from the said end of the flexible belt so that when the two elements of each fastening means are connected, a pair of belts are formed with a connecting portion therebetween, one belt being secured about an adult and the other about a child.

2. The safety device of claim 1 wherein the flexible belt is adapted to be secured about an adult's and a child's waist.

3. The safety device of claim 1 wherein the flexible belt is adapted to be secured about an adult's and a child's wrist.

* * * * *